US005822659A

United States Patent [19]

Ishiyama

[11] Patent Number: 5,822,659

[45] Date of Patent: Oct. 13, 1998

[54] IMAGE FORMING APPARATUS AND PROCESS CARTRIDGE DETACHABLY MOUNTABLE RELATIVE TO AN IMAGE FORMING APPARATUS

[75] Inventor: Harumi Ishiyama, Numazu, Japan

[73] Assignee: Canon Kabushiki Kaisha, Tokyo, Japan

[21] Appl. No.: 807,808

[22] Filed: Feb. 26, 1997

[30] Foreign Application Priority Data

Feb. 27, 1996 [JP] Japan ..... 8-065511
Feb. 20, 1997 [JP] Japan ..... 9-036140

[51] Int. Cl.[6] ..... G03G 15/02; G03G 21/00

[52] U.S. Cl. ..... 399/175; 399/150; 361/225

[58] Field of Search ..... 399/264, 149, 399/150, 115, 119, 174, 175; 361/225

[56] References Cited

U.S. PATENT DOCUMENTS 5,351,109 9/1994 Haneda ..... 361/225 X
5,357,323 10/1994 Haneda et al. ..... 361/225 X
5,426,489 6/1995 Haneda et al. ..... 361/225 X
5,579,095 11/1996 Yano et al. .
5,592,264 1/1997 Shigeta et al. ..... 399/175
5,606,401 2/1997 Yano ..... 361/221 X
5,659,852 8/1997 Chigono et al. ..... 399/175

*Primary Examiner*—R. L. Moses
*Attorney, Agent, or Firm*—Fitzpatrick, Cella, Harper & Scinto

[57] ABSTRACT

An image forming apparatus includes an image bearing member; charging means for charging the image bearing member, the charging means including magnetic field generating means and magnetic particles contactable to the image bearing member at a charging position; developing means for developing with toner a electrostatic image formed on the image bearing member using the charging means; transferring means for transferring a toner image from the image bearing member onto a recording material; wherein the developing means is capable of collecting residual toner from the image bearing member; wherein magnetic confining force acting on the magnetic particle is larger than a magnetic confining force acting on the carrier under a magnetic field formed by the magnetic field generating means at the charging position.

16 Claims, 3 Drawing Sheets

IMAGE FORMING APPARATUS AND PROCESS CARTRIDGE DETACHABLY MOUNTABLE RELATIVE TO AN IMAGE FORMING APPARATUS

FIELD OF THE INVENTION AND RELATED ART

The present invention relates to an image forming apparatus such as a copying machine, printer or facsimile machine, using an image formation process such as electrophotographic or electrostatic recording processes, and to a process cartridge detachably mountable relative to the image forming apparatus.

In such an image forming apparatus, a toner image corresponding to intended image information is formed on an image bearing member such as an electrophotographic photosensitive member or electrostatic recording dielectric member through an image formation process including an uniform charging process, electrostatic latent image forming process and developing process. The toner image is then transferred onto a recording material by a transfer device. The image bearing member after the transfer is repeatedly used for the image formation (image transfer type). It is preferable that cleaning device exclusively for removal of the residual toner (untransferred toner) remaining after the toner image transfer onto the recording material, is not provided, but the developing means is used for the removal of such toner (simultaneous development and cleaning).

In a proposed image forming apparatus of the transfer type and cleaner-less system, a contact charging device having a magnetic brush charger is used for charging the photosensitive member as the image bearing member in an electrophotographic apparatus. No independent cleaning device exclusively for the removal of the untransferred toner after the toner image transfer, is used. The untransferred toner is collected by a developing device.

The movement of the surface of the photosensitive member brings, to the developing device, the toner on the photosensitive member having passed through the charging region without being collected by the magnetic brush portion and the toner having passed through the charging region and having partly discharged from the magnetic brush portion onto the photosensitive member. The developing device collects such toner (simultaneous development and cleaning) using the DC voltage applied to the developing device at the time of the subsequent development and the potential difference Vback for removal of fog toner which is a potential difference between the DC voltage applied to the developing device and the surface potential of the photosensitive member.

The magnetic brush charger includes a magnetic brush portion of charging magnetic particle (electroconductive magnetic particle) carried, by magnetic confinement, on a rotatable or non-rotatable supporting member which also functions as an electric energy supply electrode. A member to be charged (here, image bearing member) is charged uniformly to a predetermined polarity and potential by application of a predetermined charging bias onto the supporting member while the magnetic brush portion is contacted to the image bearing member.

By temporarily collecting the untransferred toner into the magnetic brush portion of the magnetic brush charger, toner having a charge polarity which is reverted at the transfer portion, is charged to the regular charge polarity. Additionally, the untransferred toner pattern is scraped off, so the at ghost image of the untransferred toner pattern is not produced.

Such an image forming apparatus is not provided with an independent cleaning device exclusively for removal of the untransferred toner from the surface of the photosensitive member after the toner image transfer onto the recording material, and therefore, space saving advantage is significant to permit significant downsizing of the device. Additionally, the untransferred toner is finally collected back into the developing device and is reused for the next process, thus reducing the amount of the final residual toner. This is preferable from the standpoint of environmental health.

In image forming apparatuses, a corona charger has widely been used as a charging means for the image bearing member. More particularly, a corona charger is disposed faced to the image bearing member without contact thereto, and a high voltage is applied thereto to produce corona shower, to which the surface of the image bearing member is exposed, by which the surface is charged to the predetermined polarity and potential. Recently, however, a contact charging device is widely used because of the advantage of smaller amount of ozone product and because of the low voltage and the low electric power, or the like. With this charging system, an electroconductive member supplied with a predetermined charging bias (contact charging member such as a charging roller, charging blade, magnetic brush, fur brush or the like), is contacted to surface of the image bearing member, by which the surface of the image bearing member is charged to a predetermined polarity and potential.

The above-described example of the cleanerless image forming apparatus uses a magnetic brush charger as the contact charging device for the image bearing member.

However, in such a cleanerless type image forming apparatus as described above, if the developing device for visualizing the formed latent image into a toner image uses a two component developer comprising toner (non-magnetic property) and developer carrier (magnetic property), the developer carrier may be deposited on the image bearing member in a developing zone and may be carried over to the magnetic brush charger and may be introduced into the magnetic brush portion. When the image forming apparatus is subjected to long term use, a quite a large amount of the developer carrier is accumulated in the magnetic brush portion of the magnetic brush charger.

The toner has a higher resistance than the charging magnetic particle constituting the magnetic brush portion of the magnetic brush charger. However, it has a much smaller particle size than the charging magnetic particle, and the magnetic confining force per one particle, and therefore, even if the untransferred toner is introduced into the magnetic brush portion of the magnetic brush charger, it is subsequently discharged therefrom with the result that amount thereof accumulated in the magnetic brush portion is relatively small. Accordingly, the charging property of the magnetic brush charger is not substantially deteriorated. However, the developer carrier has a higher resistance than the charging magnetic particle, and in addition, it has a particle size which is comparable to the charging magnetic particle, and the magnetic confining force per one particle is large, with the result that it is not easily discharged from the brush. The accumulated amount of the developer carrier particles in the magnetic brush portion of the magnetic brush charger gradually increases, and the resistance value of the entirety of the magnetic brush portion gradually increases, accordingly. Then, the charging property of the magnetic brush charger is deteriorated. Because of this, the output image quality becomes deteriorated (image quality defect).

In the case of an image forming apparatus provided, between the transfer device and the magnetic brush charger, with a cleaning device exclusively for removing the untransferred toner from the surface of the photosensitive member after the toner image transfer to the recording material in the transferring device, the developer carrier, if any, deposited on the photosensitive member in the developing zone, is removed from the surface of the photosensitive member by the cleaning device before the magnetic brush charger. Therefore, the apparatus is free of the problem of the deterioration of the charging property resulting from the accumulation of the developer carrier in the magnetic brush portion of the magnetic brush charger.

SUMMARY OF THE INVENTION

Accordingly, it is a principal object of the present invention to provide an image forming apparatus and a process cartridge wherein the deterioration of the charging property due to introduction of the developer carrier into the magnetic powder or particles of the charging means.

It is another object of the present invention to provide an image forming apparatus and a process cartridge wherein the developer carrier is easily discharged from the magnetic powder of the charging means.

It is a further object of the present invention to provide an image forming apparatus and a process cartridge, wherein the deterioration of the image quality due to introduction of the developer carrier into the magnetic powder of the charging means.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS (First Embodiment)

(1) Structure of an Example of an Image Forming Apparatus

Figure 1:
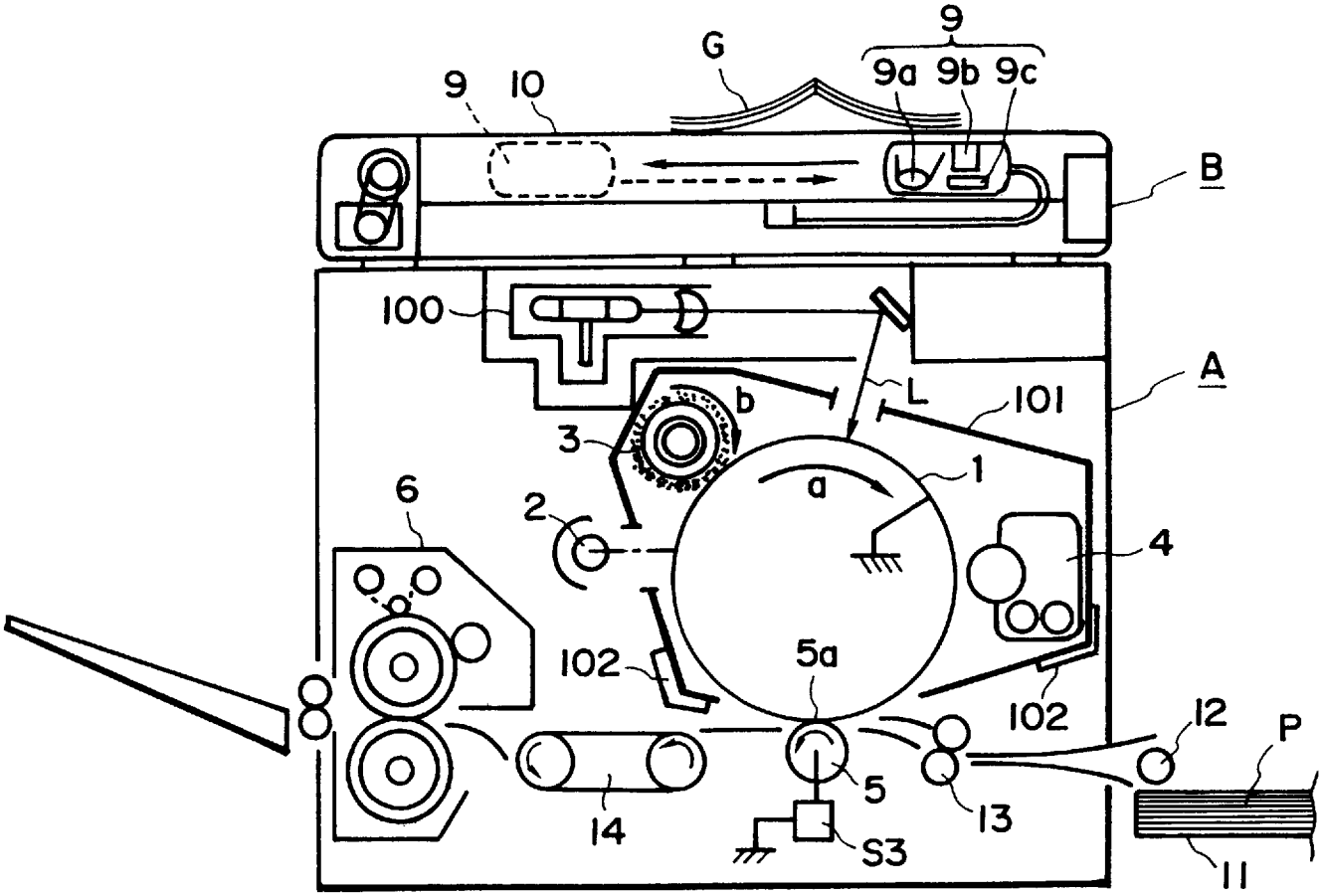
FIG. 1 is a schematic illustration of an image forming apparatus of a cleanerless type according to embodiment 1 of the present invention.

FIG. 1 is a schematic view of an example of an image forming apparatus according to Embodiment 1 of the present the invention.

The image forming apparatus of this example is a detachable process cartridge type laser beam printer using an image transfer type electrophotographic process.

A charging device for the image bearing member (photosensitive member) is a contact charging device using a magnetic brush charger, and a developing device uses a two component developer comprising developer carrier and toner and functions to collect residual toner from the image bearing member (cleaner-less system).

Designated by A is a laser beam printer, and B is an image reader or scanner for reading an image, placed on the printer.

a. Image Reading Device B

In the image reading device B, designated by 10 is an original supporting platen glass fixed on the upper surface of the device, and an original G to be copied is placed face down on the top surface of the original supporting platen glass, and is covered by an unshown original cover it.

Designated by 9 is an image reading unit including an original illumination lamp 9*a*, a short focus lens array 9*b*, CCD sensor 9*c* and the like. The unit 9, upon actuation of an unshown copy key, is moved forward along a bottom surface of the glass from its home position at the right-hand portion, and upon arrival at a predetermined forward movement end portion, it is moved backward to the home position.

During the forward movement driving stroke of the unit 9, the image surface of the set original G on the original supporting platen glass 10 is illuminated and scanned from the right-hand side to the left-hand side by the original projection lamp 9*a* of the unit 9, and the light reflected by the surface of the original is imaged on a CCD sensor 9*c* by the short focus lens array 9*b*.

CCD sensor 9*c* includes a light receiving portion a, transfer portion and an output portion. A light signal is converted to a charge signal by the light receiving CCD portion, and the charge signal is transferred to an output portion in synchronization with clock pulses by a transfer portion. In the output portion, the charge signal is converted to a voltage signal, which is then amplified with impedance reduction treatment, and the resultant signal is outputted. The analog signal provided in this manner, is subjected to a known image processing, so that digital signal is produced and is fed to the printer A.

Namely, the image reading device B carries out photoelectric reading of the image information of the original G and conversion thereof to a time series electrical digital pixel signal (image signal).

b. Printer A

In the printer A, designated by 1 is an electrophotographic photosensitive member (photosensitive drum) of a rotatable drum type as an image bearing member. The photosensitive drum 1 is rotated about its axis at a predetermined peripheral speed (process speed), more particularly, at the rotational speed 150 mm/s in this example, in a clockwise direction a indicated by the arrow. During the rotation, it is subjected to discharging exposure by a pre-exposure lamp, and is then subjected to uniform charging of a negative (in this embodiment) by a magnetic brush charger 3.

The thus charged surface of the photosensitive member 1 is exposed to and scanned by a laser scanner 100 having an intensity modulated in accordance with image signal fed to the printer A from the image reading device B, corresponding to the intended image information, so that electrostatic latent image thereof is formed in accordance with the image signal.

The formed electrostatic latent image on the surface of the rotatable photosensitive drum 1 is developed sequentially into a toner image by the developing device 4. In this embodiment, a reverse development system is used wherein the low potential portion of the latent image comprising high potential and low potential portions, receives the toner.

On the other hand, a recording material (transfer material) P accommodated in a sheet feeding cassette 11 is, fed out by sheet feeding rollers 12 one by one, and is fed into the printer A. It is fed to the transfer portion 5*a* in the form of a contact nip between the photosensitive drum 1 and a transfer roller 5 as a transferring means at a predetermined controlled timing by registration rollers 13. The transfer roller 5 is supplied with a transfer bias of the polarity opposite from that of the toner from the transfer bias application voltage source S3 at a predetermined controlled timing so that toner image is electrostatically transferred from the surface of the photosensitive drum 1 onto a surface of the recording material P fed into the transfer portion 5*a*.

The recording material P having received the toner image at the transfer portion 5*a* is then separated sequentially from the surface of the photosensitive drum 1, and is fed by a feeding device 14 to a fixing device 6, where the toner image is heated and fixed on the recording material. Then, the recording material is discharged as a copy or print.

The untransferred toner remaining on the surface of the rotatable photosensitive drum 1 after the toner image transfer onto the recording material P, is brought to the position of the magnetic brush charger 3 by the continued rotation of the photosensitive drum 1, and is temporarily collected by the magnetic brush portion (simultaneous charging and cleaning). The photosensitive drum 1 is charged by the charger 3 while the residual toner passes by the magnetic brush charger 3, and while the toner is discharged from the magnetic brush charger 3 to the photosensitive drum 1. The area of the photosensitive drum 1 where the toner is present, is subjected to the image exposure operation so that electrostatic latent image is formed, and then is subjected to the simultaneous development and cleaning operation by the developing device 4. For the simultaneous development and cleaning operation, a developing sleeve of the developing device 4 is supplied with a bias voltage having a voltage level which is between the potentials of the high potential portion and the low potential portion of the electrostatic latent image, so that toner is transferred from the developing sleeve to the low potential portion, and simultaneously there with, the residual toner is collected from the high potential portion to the developing sleeve.

(2) Process Cartridge 101

Designated by 101 is a process cartridge which is detachably mountable relative to a predetermined portion in a main assembly of the printer. In the apparatus of this example, the photosensitive drum 1 as the image bearing member, the magnetic brush charger 3 and the developing device 4 (three process means), are mounted in a cartridge casing with a predetermined mutual disposition relationship, so that process cartridge is constituted.

The process cartridge 101 is mounted to a predetermined portion in the main assembly of the printer, by which the process cartridge 100 and the main assembly of the printer are mechanically and electrically coupled with each other, and the image forming operation of the printer is enabled. Designated by 102 are members for guiding and supporting the process cartridge 101. The cartridge 101 may contain the photosensitive drum 1 and at least one of the charger 3 and the developing device 4.

(3) Photosensitive Drum 1

As for the material of the image bearing member, organic photosensitive member (OPC) is usable, which is normally used for a photosensitive drum 1. Desirably, it is a photosensitive member having an outermost charge injection layer of low resistance, or an amorphous silicon photosensitive member or the like which has a surface layer having a resistance of $10^9$–$10^{14}$ Ω.cm. Then, the charge injection charging is usable with the advantage of small ozone production, so that charging property is improved.

In this example, the photosensitive member 1 is an organic photosensitive member having a surface charge injection layer in which electroconductive particles ($SnO_2$) are dispersed to provide the volume resistivity of $10^{13}$ Ω.cm. approx.

Figure 2:
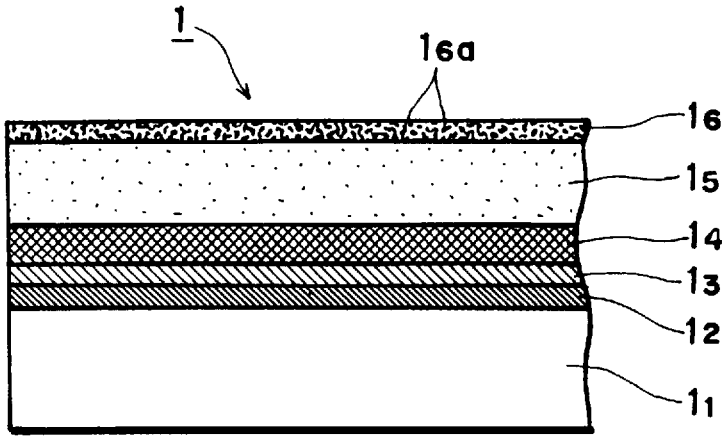
FIG. 2 shows a schematic layer structure a photosensitive drum as an image bearing member.

In other words, the photosensitive drum 1 of this example is a negatively chargeable OPC photosensitive member having a surface charge injection layer, and has, on an aluminum drum base having a diameter of 30 mm, the following five function layers. FIG. 2 is a schematic view of the layers.

From the aluminum drum base $\mathbf{1}_1$ side, there are a primer layer $\mathbf{1}_2$ as a first layer, a positive charge injection preventing layer $\mathbf{1}_3$ as a second layer, a charge generating layer $\mathbf{1}_4$ as a third layer, a charge transfer layer $\mathbf{1}_5$ as a fourth layer, and a charge injection layer $\mathbf{1}_6$ as a fifth layer, in the order named. First layer to fourth layer are used in an usual OPC photosensitive member of the functionally-separated type. It may be in the form of a monolayer type OPC, ZnO, selenium, amorphous silicon or the like photosensitive member.

The fifth layer (surface layer) (charge injection layer $\mathbf{1}_6$) of this example comprises acrylic resin material of photocuring type as a binder resin material, and $SnO_2$ ultra-fine particles $\mathbf{1}_6$ as electroconductive particles (electroconductive filler) dispersed therein. More particularly, the $SnO_2$ particles having an average particle size to approx. 0.03 μm which have been subjected to low resistance treatment by doping antimony, are dispersed in the resin material at a ratio of 5:3 by weight. Furthermore, charging magnetic particles for constituting the magnetic brush layer of the magnetic brush charging equipment 3, and fine particles of tetrafluoroethylene resin material (PTFE: tradename of Teflon, available from Dupont) having an average size of 0.3 μm, are dispersed therein. There ratio thereof in total is 33% by weight. The tetrafluoroethylene resin material is effective to improve the parting property. The coating liquid as described above is applied through dip coating or the like into a thickness of approx. 3 μm to provide the charge injection layer $\mathbf{1}_6$.

Actually, the volume resistivity of the charge injection layer $\mathbf{1}_6$ changes with the dispersion amount of the electroconductive $SnO_2l_6a$. To prevent production of image flow, the resistance value of the charge injection layer $\mathbf{1}_6$ is preferably not less than $1\times10^8$ Ω.cm.

The resistance value of the charge injection layer $\mathbf{1}_6$ is measured in the following manner. The charge injection layer is applied or painted on an insulative sheet, and the surface resistance thereof is measured using high resistance meter 4329A available from Hewlett-Packard, with the applied voltage of 100 V. In this example, the volume resistivity of the charge injection layer $\mathbf{1}_6$ was $1\times10^{12}$ Ω.cm.

(4) Magnetic Brush Charger 3

Figure 3:
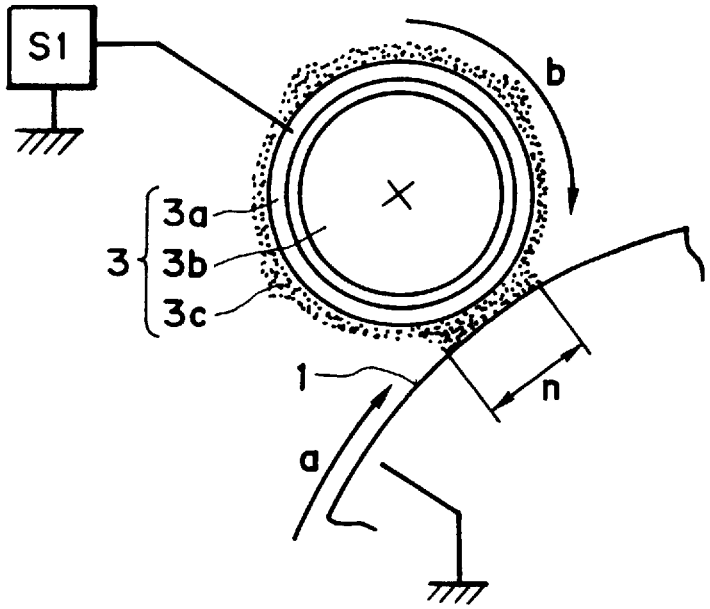
FIG. 3 shows a structure of a magnetic brush charger.

FIG. 3 is an illustration of the magnetic brush charger 3. The magnetic brush charger 3 is of a rotatable sleeve type, and comprises a sleeve (charging sleeve) 3*a* of non-magnetic and electroconductive material having an outer diameter of 20 mm, a magnet roller 3*b* as a magnetic field generating means disposed stationarilly in the sleeve, and a magnetic brush portion 3*c* of charging magnetic particles (electroconductive magnetic particles) magnetically attracted on the outer peripheral surface of the charging sleeve 3*a* by the magnetic force provided by the magnet roller 3*b*. The magnetic brush portion 3*c* is contacted to the surface of the photosensitive drum 1 to constitute a charging station or portion, namely a charging nip or charging region.

The charging sleeve 3*a* is rotated in the direction for counterdirectional peripheral movement relative to the photosensitive drum 1 at the contact portion n with the photosensitive drum 1. More particularly, the photosensitive drum 1 is rotated at a peripheral speed of 150 mm/sec, and the charging sleeve 3*a* is rotated at the peripheral speed of 225 mm/sec. By the rotation of the charging sleeve 3*a*, the magnetic brush portion 3*c* is rotated to rub the he surface of the photosensitive drum 1.

The magnetic flux density at the charging sleeve surface in the closest position between the photosensitive drum 1 and the charging sleeve 3*a*, is 1000 Gauss. The width of the magnetic brush portion, 3*c* is 300 mm, and charging magnetic particle amount constituting the magnetic brush portion 3*c* is approx. 40 g, and the gap between the charging sleeve 3*a* and the photosensitive drum 1 is 500 μm approx. at the nip.

The charging sleeve 3*a* of the magnetic brush charger 3 is supplied with a predetermined charging bias from a charging bias voltage source S1, so that electric energy supply occurs to the photosensitive drum 1 in the charging portion n through the magnetic brush portion 3*c*, by which the surface of the photosensitive drum 1 is uniformly charged to the polarity and the potential substantially corresponding to the DC voltage component (DC bias component) of the applied charging bias (charge injection charging system, in this example).

With respect to the rotational speed of the charging sleeve 3*a*, the charging uniformity tends to increase with increase of the speed.

In the case of the charge injection charging type, the photosensitive drum potential of −700 V is provided when the DC charging bias voltage is −700 V. In this image forming apparatus wherein the untransferred toner is mixed into the magnetic brush portion 3*c*, the magnetic brush charger 3 is supplied with an AC biased DC charging bias which comprises a DC voltage of −700 V and an alternating voltage (AC bias) which has a frequency Vf of 1000 Hz, an amplitude (peak-to-peak voltage) Vpp of 1000 V. With these values, satisfactory charging property is provided. The charging bias applied to the magnetic brush charger 3 is not limited to the above-described one, but may be properly selected by one skilled in the art.

As regards the particle size of the charging magnetic particle, it is preferably small from the standpoint of the uniform charging, but if it is too small, the charging magnetic particle deposition to the photosensitive drum 1 occurs because of relation between the magnetic force and the particle size. The number average particle size of the charging magnetic particles is preferably 10–100 μm, and 10–50 μm is further preferable from the standpoint of the uniform charge, and even further preferably, it is 15–50 μm from the standpoint both of the uniform charging and the prevention of the charging magnetic particle deposition. If the charging magnetic particle size exceeds 100 μm, the specific surface area with which the magnetic brush rubs the photosensitive drum, decreases with the result of insufficient charging, and trace of brushing due to the magnetic brush of the charging magnetic particle is produced in the image, and therefore, the range higher than that is not preferable from the standpoint of the uniform charge. If it is smaller than 15 μm, the magnetic force of one charging magnetic particle is small with the result of the higher tendency of the charging magnetic particle deposition. The particle size measuring method for the magnetic particle powder will be described hereinafter.

As regards the resistance value of the magnetic particle, if it is too high, the charge cannot be uniformly injected into the photosensitive drum with the result of foggy images due to improper charging in small areas. If it is too low, the current concentratedly flows through a pin hole if any in the photosensitive drum surface with the result of charge potential drop, so that photosensitive drum surface is not charged, and therefore, the uneven charging in the form of the charging nip occurs. Accordingly, the resistance value of the magnetic particle is preferably $1\times10^5$–$1\times10^8$ Ω.cm. The resistance value of the magnetic particle is measured in the following manner: 2 g of the magnetic particle is placed in a metal cell having a bottom surface area of 228 $mm^2$ to which a voltage is applicable, and then the load of 6.6 $kg/cm^2$ is applied, and the current is measured when a voltage of 100 V is applied.

The charging magnetic particles used in this example were ferrite particles of the following properties:

Average particle size: 30 μm

Saturation magnetization at 1000 Gauss: 280 $emu/cm^3$

Resistance: $6\times10^7$ Ω.cm.

In the charge injection charging, it is preferable that charge injection is effected (the charge is directly injected into an electronic unit in the outermost layer) into the surface of the member to be charged (photosensitive member) having an intermediate surface resistance by a contact charging member having an intermediate resistance. In this example, the charge is not injected to the trap potential in the photosensitive member surface material, but the charging is effected to the electroconductive particle $\mathbf{1}_6$a ($SnO_2$) of the charge injection layer $l_6$. The charging model thereof is such that charging is effected by the contact charging member 3 to a fine capacitor constituted by a dielectric member which is the charge transfer layer $\mathbf{1}_5$ and both electrode plates one of which is the drum fundamentals $\mathbf{1}_1$ of aluminum and the other of which is the electroconductive particle $\mathbf{1}_6$a in the charge injection layer $\mathbf{1}_6$. Here, the electroconductive particles $\mathbf{1}_6$a are electrically independent from each other, and therefore, they each constitute a kind of fine float electrode. Therefore, the photosensitive member surface seems to be charged to an uniform potential, macroscopically, but the fact is as if a great number of charged fine electroconductive particles of $SnO_2$ covers the photosensitive member surface. Accordingly, even if the image exposure L is carried out, the electrostatic latent image can be retained, since the respective $SnO_2$ particles $\mathbf{1}_6$a are electrically independent from each other.

(5) Developing Device 4

Figure 4:
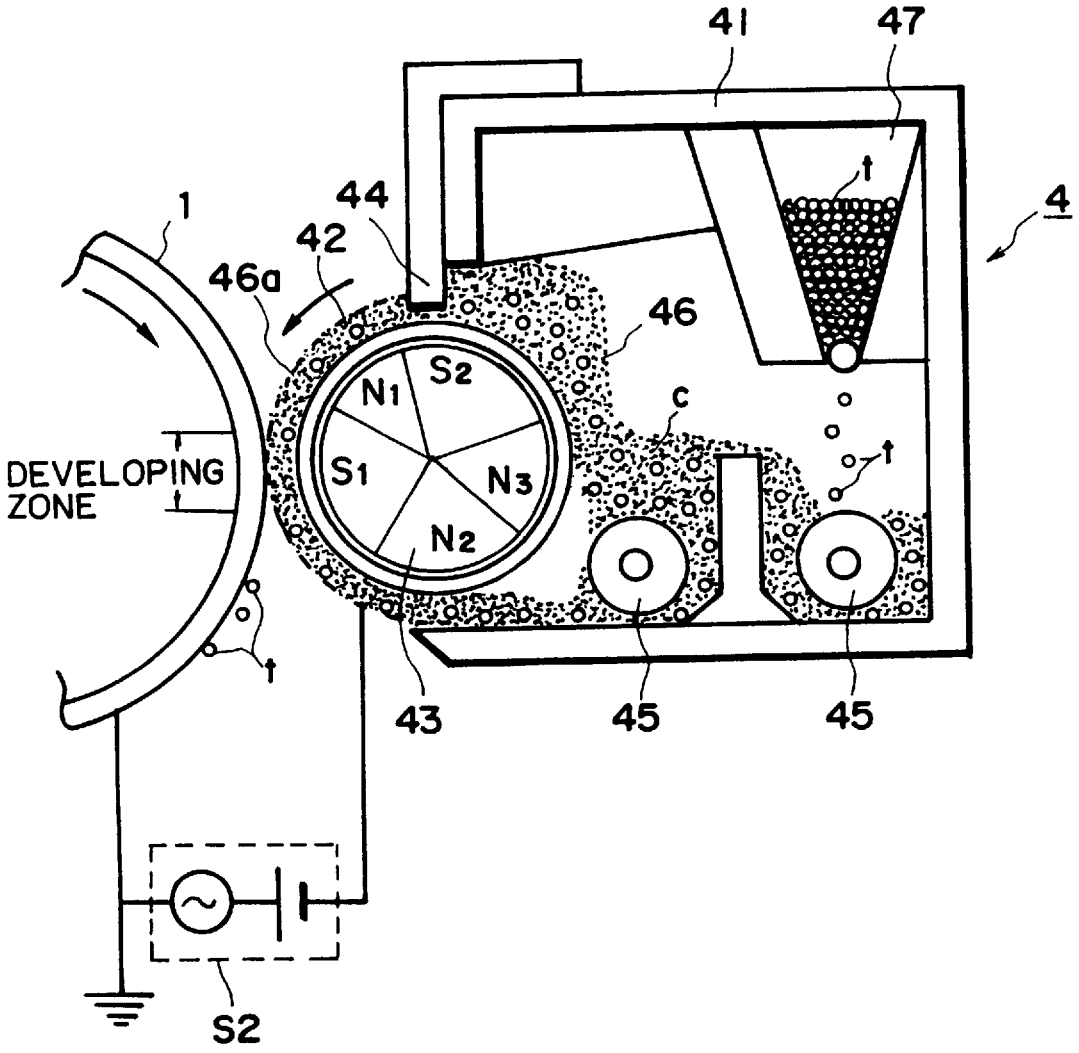
FIG. 4 is a schematic view of a developing device.

FIG. 4 is a schematic view of the developing device 4 of the two-component contact type developing type (two-component magnetic brush type development) used in this example.

Designated by 41 is a developing container; 42 is a developing sleeve as the developer carrying member; 43 is a magnet roller as a magnetic field generating means stationarilly fixed in the developing sleeve 42; 44 is a developer layer thickness regulating blade for forming a thin layer of the developer on developing sleeve surface; 45 is a developer stirring and feeding screw; 46 is the two component developer accommodated in the developing container 41, which comprises non-magnetic toner particles t and magnetic carrier particles (developer carrier) c mixed therewith. Designated by 47 is a toner supplying portion.

The developing sleeve 42 is so disposed that at least at the time of the development operation, it is placed with the closest distance from the photosensitive drum 1 being approx. 500 μm, so that magnetic developer brush thin layer 46*a* on the outer surface of the developing sleeve 42 is contacted to the surface of the photosensitive drum 1. The contact portion between the magnetic developer brush thin layer 46*a* and the photosensitive drum 1 is a developing zone (developing zone).

The developing sleeve 42 is rotated around the stationary magnet roller 43 in the counterclockwise direction indicated by the arrow at a predetermined rotational speed. In the developing container 41, a magnetic brush of the developer 46 is formed on the outer surface of the sleeve by the magnetic force of the magnet roller 43. The magnetic developer brush is fed with the rotation of the sleeve 42, and is subjected to layer thickness regulation by the blade 44 so as to be a magnetic developer brush thin layer 46*a* having a predetermined layer thickness, and is carried out of the developing container to the developing zone. It is contacted to the surface of the photosensitive drum 1, and is returned into the developing container 41 by the continuing rotation of the sleeve 42.

Between the developing sleeve 42 and the electroconductive drum base of the photosensitive drum 1, a developing bias in the form of a DC voltage plus alternating voltage, is applied from a developing bias applying voltage source S2.

In this example, the developing bias voltage is as follows:

DC voltage: −500 V

Alternating voltage: amplitude Vpp=1500 V, and frequency Vf=2000 Hz

In the developing zone, the toner t in the magnetic developer brush thin layer 46*a* at the developing sleeve 42 side is selectively deposit d to the drum in accordance with the electrostatic latent image thereon, so that electrostatic latent image is developed into the toner image.

Generally, the application of the alternating voltage is effective to increase the development efficiency so that image quality is improved in the two-component developer type developing method, but the fog tends to be produced. Therefore, a potential difference is provided between the DC voltage applied normally to the developing device 4 and the surface potential of the photosensitive drum 1, by which the fog production is prevented.

The toner content in the developer 46 in the developing container 41 (mixture ratio relative to the carrier) gradually decreases by the consumption of the toner to develop the electrostatic latent image. The toner content in the developer 46 in the developing container 41 is detected by unshown detecting means. When it decreases to a predetermined level, the toner supply is carried out from a toner supplying portion 47 into the developer 46 in the developing container 41 to maintain a predetermined permissible range of the toner content in the developer 46 in the developing container 41 (toner supply control).

The description will be made as to a circulating system for the developer in the developing device 4. The developer 46 is taken up on the sleeve by $N_3$ pole of the magnet roller 43 with rotation of the developing sleeve 42, and is moved by $S_2$ pole and $N_1$ pole. Then, the developer is regulated by a regulating blade 44 disposed perpendicularly to the developing sleeve 42 so that thin layer 46*a* of the developer 46 is formed on the developing sleeve The developer layer 46*a* thus formed in the thin layer is fed to the position of the main developing pole $S_1$ in the developing zone, where it is reformed as chains of developer by the magnetic force. The electrostatic latent image on the photosensitive drum 1 is developed into a toner image by the developer layer 46*a* in the form of chains. The residual toner remains on the photosensitive drum 1, and is temporarily collected by the magnetic brush portion 3*c* of the magnetic brush charger 3 as the contact charging member, and is charged to the regular polarity (negative). The toner is then discharged to the drum 1, and is collected back into the developer layer 46*a* on the developing sleeve 42. Thereafter, the developer on the developing sleeve 42 is returned into the developing container 41 by a repellent magnetic field provided by the $N_2$ pole and the $N_3$ pole.

The two component developer used in this embodiment comprises:

Toner particles t: negative charged toner powder manufactured through a pulverization method and having an average particle size of 6 $\mu$m added with oxide titanium particles having an average particle size of 20 nm (weight ratio of 1%).

Carrier c: magnetic carrier powder having an average particle size of 30 $\mu$m and a saturation magnetization of 130 emu/cm$^3$ at 1000 Gauss The toner and carrier were mixed at weight ratio of 7:93.

Here, the description will be made as to a measuring method of the toner particle size distribution.

The used measuring device was Coaltar counter TA-2 type, available from Coaltar, to which an interface, available from Nikkaki Kabushiki Kaisha, for outputting a number average distribution and volume average distribution, to which CX-1 personal computer, available from Canon Kabushiki Kaisha, is connected. NaCl aqueous solution (1%) was prepared using first class chloride sodium as electrolytic solution.

Into the electrolytic aqueous solution 100–150 ml, surfactant as dispersion material, preferably 0.1–5 ml of alkylbenzensulfonate is added, and also, 0.5–50 mg of the measurement sample is added.

The electrolytic solution containing the suspended sample is subjected to dispersion process by an ultrasonic dispersion device for approx.1–3 minutes, and the particle size distribution of the particles having the sizes of 2–40 $\mu$m is measured using the Coaltar counter TA-2 type and a 100$\mu$ aperture, and the volume average distribution is determined. The volume average particle size is obtained from the volume average distribution thus determined.

(6) Transfer Device 7

In this example, the transferring means is in the form of a transfer roller 7, which is contacted to the photosensitive drum 1 to form a nip as a transfer portion 7*a*.

The transfer roller 8 of this example comprises a core metal of an electroconductive rigid material such as metal and having an outer diameter of 8 mm, and an electroconductive elastic layer of a foamed elastic member produced by dispersing an electroconductive material such as carbon in urethane, EPDM (ethylenepropylenediene rubber) or the like to provide a resistance value of $10^5$–$10^{10}$ 106 .cm. and a Asker C hardness of 20–50 degrees approx. The outer diameter is 16 mm, and the roller is driven by the rotation of the photosensitive drum 1 at the same peripheral speed as the drum. During the transfer operation, the core metal of the transfer roller 7 is supplied with a transfer bias (DC voltage of approx. +4 kV) from a transfer bias application voltage source S3. Between the photosensitive drum 1 and the transfer roller 7, a transferring electric field is formed in the direction of transferring the negative polarity toner particles forming the toner image onto the recording material P, by electrostatic transfer.

(7) Charging Magnetic Particle and Developer Carrier a) The surface of the photosensitive drum 1 carries untransferred toner thereon after the toner image transfer to the recording material P. The untransferred toner is, as has been described hereinbefore, passed by the magnetic brush portion 3*c* of the magnetic brush charger 3 and is temporarily collected (simultaneous charging and cleaning). In addition, the toner discharged from the magnetic brush portion 3*c* is collected by the developing device 4 (simultaneous development and cleaning).

b) On the other hand, the developer carrier in the developing device 4 may be deposited onto the surface of the photosensitive drum 1 in the developing zone; may then be carried over to the magnetic brush charger 3 with the rotation of the photosensitive drum 1; and may then be mixed into the magnetic brush 3*c*.

The developer carrier of the two component developer is effective to charge the toner to the negative polarity in this example by rubbing with the toner in the developing device, and therefore, the developer carrier per se is charged to the positive polarity. So, in the developing zone, the developer carrier deposited on the photosensitive member 1 is charged to the positive polarity. The carrier particles are hardly transferred onto the recording material P by the transferring electric field provided by the positive transfer bias which is applied to the transfer roller 7 for the electrostatic transfer of the negative charged toner onto the recording material P. Therefore, they remains deposited on the photosensitive drum 1, and are carried over to the magnetic brush charger 3 and are mixed into the magnetic brush portion 3*c*.

c) In order to positively charge the toner through triboelectricity, the developer carrier has a higher resistance than the charging magnetic particle, and therefore, if the developer carrier is mixed into the magnetic brush portion 3*c* of magnetic brush charger 3 and is accumulated there, the charging property of the magnetic brush portion 3*c* is deteriorated.

d) In this example, in order to discharge the mixed developer carrier if any from the magnetic brush portion 3*c*, the charging magnetic particles and the developer carrier for constituting the magnetic brush portion 3*c*, have the following properties.

(1) Charging Magnetic Particle

Average particle size: 30 $\mu$m

Volume resistivity: $6\times10^{7}$ Ω.cm.

Saturation magnetization at 1000 Gauss: 280 emu/cm$^3$

Density; 5.2 g/cm$^3$

Material: ferrite particle (2) Developer Carrier

Average particle size: 30 $\mu$m

Volume resistivity: $9\times10^{13}$ Ω.cm.

Saturation magnetization at 1000 Gauss: 130 emu/cm$^3$

Density: 3.5 g/cm$^3$

Material: resin material carrier

The charging magnetic particle and the developer carrier are imparted by magnetic confining force toward the charging sleeve 3*a* and the electrostatic force toward the photosensitive drum 1 by the magnetic field of the magnet roller 3*b*, respectively. The electrostatic force significantly varies in accordance with deterioration by long term use or by ambient conditions such as temperature and/humidity around the device. In this embodiment, at least the developer carrier is discharged from the charging magnetic brush during the operation of the apparatus, by providing the magnetic confining force with difference, the magnetic confining force being stable as compared with the electrostatic force.

More particularly, the magnetic confining force Fr in the direction toward the charging sleeve (or direction in a polar co-ordinate with the point of origin being the center of the charging sleeve)

$$\begin{aligned} |\vec{Fr}| &= (\delta/\delta r)M\cdot|\vec{B}| \\ &= M\cdot(\delta/\delta r)|\vec{B}| \end{aligned}$$

M is magnetization of one particle=$\sigma v\cdot 4/3\cdot\pi\cdot d^3$, $\sigma v$=magnetization per unit volume (equivalent to the saturation magnetization under 1000 Gauss), d=particle size of the particle, $|\vec{B}|$=absolute value of external magnetic field in charging region, $(\partial/\partial r)\ |\vec{B}|$=absolute value of change rate of the external magnetic field toward the charging sleeve center.

Adjacent the surface of the magnetic brush in the charging region n, the external magnetic field acting on the charging magnetic particle and the external magnetic field acting on the developer carrier are substantially the same, and therefore, using different magnetization per unit particle 1 is effective as means for proving different magnetic confining force. By this, even if there is a variation in the electrostatic force, the magnetic confining force of the charging magnetic particle is kept always larger than that of the developer carrier. When the device is used for a long term, the developer carrier tends to be discharged onto the photosensitive drum from the charging magnetic brush, and as a result, the amount of the developer carrier accumulated in the magnetic brush decreases. Thus, the charging magnetic brush can maintain its stabilized charging property.

The magnetization per one particle 1 of the charging magnetic particles used in this embodiment is $40\times10^{-6}$ emu, and the magnetization of the developer carrier is $1.8\times10^{-6}$ emu.

The developer carrier discharged onto the photosensitive drum 1 from the magnetic brush portion 3*c* is carried to a developing device 4 in accordance with the continued rotation of the photosensitive drum 1. It is subjected to magnetic confinement to the developing sleeve 42 by the magnetic field of the magnet roller 43 in the developing sleeve 42, and is collected.

Namely, the mixed development carrier is discharged from the magnetic brush portion 3*c*, and is collected by the developing device 4, so that it is prevented from accumulating in the magnetic brush portion 3*c*.

Actually, when 10,000 image formations were carried out, no improper charging due to the accumulation of the developer carrier in the magnetic brush portion 3*c* of the magnetic brush charger 3, observed, and good images were formed continuously.

e) Operation of a comparison example was carried out, wherein the saturation magnetizations per one particle of the charging magnetic particles and the developer carriers under the magnetic field in the charging region n, are the same (3) and (4), as contrasted to (1) and (2), and the other conditions are the same as above. When 5,000 image forming operations were carried out, image defect was absorbed which is attributable to the improper charging due to the accumulation of the developer carrier in the magnetic brush portion 3*c*.

(3) Charging Magnetic Particle

Average particle size: 30 $\mu$m

Volume resistivity: $6\times10^{7}$ Ω.cm.

Saturation magnetization at 1000 Gauss: 280 emu/cm$^3$

Material: ferrite particle (4) Developer Carrier

Average particle size: 30 $\mu$m

Volume resistivity: $9\times10^{13}$ Ω.cm.

Saturation magnetization at 1000 Gauss: 280 emu/cm$^3$

Material: coated carrier f) Experiments on difference of the magnetic confining force between the charging magnetic particle and the developer carrier.

The same amount (approx. 1 g) of the charging magnetic particle and the developer carrier are placed on a non-magnetic flat plate. A magnet for providing an external magnetic field close to the charging region n, is produced, and the magnet is moved until the magnetic field in the charging region n is obtained. The difference in the magnetic confining force was confirmed depending on whether the particle is deposited or not. The most of the charging magnetic particles were deposited to the magnet before the magnetic field of the charging region is reached. Only 10% approx. of the developer carrier is deposited to the magnet, and the rest (90%) remains on the flat plate. Here, % is on the basis of weight.

Since a large amount of the toner is present in the developing device, the developer carrier is hardly deposited onto the drum 1 because of the electrostatic deposition to the drum 1 by the toner. In a few cases wherein images consuming a large amount of the toner are continuously formed, the amount of the toner decreases with the result that developer carrier may be deposited onto the drum 1.

g) The description will be made as to measuring method for the average particle size, the resistance value and the magnetic property of the charging magnetic particle and the developer carrier particle.

(1) Average particle size

More than 100 particles are randomly extracted using an optical microscope or a scanning type electron microscope, and a volume particle size distribution is calculated with the maximum angular distance in the horizontal direction, and the average particle size is defined as the 50% average particle size thereof. Alternatively, the use may be made with a laser diffraction type particle size distribution measuring device HEROS, available from Nippon Denshi KABUSHIKI KAISHA, and a range of 0.05 $\mu$m–200 $\mu$m is divided into 32 sections, which are then measured thereby. The average particle size may be defined as the 50% average particle size of the volume distribution.

(2) Resistance value

The resistance value of the particle is measured as follows: 2 g of the particle is filled in a cylindrical container having a bottom surface area of 227 $mm^2$, and it is pressed at 6.6 $Kg/cm^2$; then, the voltage of 100 V is applied in a vertical direction, the resistance is calculated and regularized from the current.

(3) Magnetic property

For the magnetic property measurement of the particle, automatic DC magnetization B-H property recording device BH-50, available from Riken Denshi Kabushiki Kaisha, is usable. The particles are filled into a cylindrical container having a diameter (inner diameter) 6.5 mm and height 10 mm, at approx. 2 g, and motion of the particle in the container is prevented. The saturation magnetization is measured from the B-H curve. In order to measure the magnetization of the magnetic particle in the charging region n, particularly, the external magnetic field comparable to that in the charging region is produced, and the measurement is then effected. The magnetic field in the charging region in this embodiment is 1000 Gauss, and therefore, the saturation magnetization at 1000 Gauss is used.

h) The saturation magnetization of the charging magnetic particle is made larger than the saturation magnetization of the developer carrier in this manner, the magnetic confining force to the developer carrier in the magnetic field in the charging region, is made smaller than that to the charging magnetic particle, so that developer carrier introduced into the magnetic brush portion 3*c* of the magnetic brush charger 3 is not easily discharged from the magnetic brush portion. Therefore, the developer carrier is prevented from accumulating in the magnetic brush 3*c* of the magnetic brush charger 3, and therefore, good charging property can be maintained, for a long term, even if there is no cleaning device exclusively therefor, and the untransferred toner is collected by the magnetic brush charger 3 and the two-component developer type developing device 4.

Thus, small size image forming apparatus providing high image quality, can be accomplished.

(Second Embodiment)

This embodiment, is different from the first embodiment, only in that average particle size of the developer carrier is made smaller than the average particle size of the charging magnetic particle. By doing so, the mixed development carrier is discharged from the magnetic brush portion 3*c* even if the developer carrier is mixed into the magnetic brush portion 3*c* of the magnetic brush charger 3.

The charging magnetic particle and the developer carrier used in this example have the following properties.

(1) Charging magnetic particle

Average particle size: 30 $\mu$m

Volume resistivity: $6\times10^7$ Ω.cm.

Saturation magnetization at 1000 Gauss: 280 $emu/cm^3$

Material: ferrite particle (2) Developer carrier

Average particle size: 20 $\mu$m

Volume resistivity: $9\times10^{13}$ Ω.cm.

Saturation magnetization at 1000 Gauss: 280 $emu/cm^3$

Material: coated carrier

The device structure, the set conditions and the like are the same as with the first embodiment, and therefore, detailed description thereof is omitted for simplicity.

Actually, when 20,000 image formations were carried out, no improper charging due to the accumulation of the developer carrier in the magnetic brush portion 3*c* of the magnetic brush charger 3, observed.

The deposition of the charging magnetic particle and the developer carrier are measured through the same deposition amount measuring method as in Embodiment 1, and it was confirmed that most of the charging magnetic particles were deposited on the magnet, but only 7 weight % of the developer carriers deposited thereon, and the rest, namely, 93 weight % remains.

The magnetic confining force is proportional to the volume of the particle, and therefore, the magnetic confining force becomes 30% by reducing the particle size of the developer carrier from 30 $\mu$m to 20 $\mu$m, and therefore, the developer carrier mixed into the magnetic brush portion 3*c* of the magnetic brush charger 3 is very easily discharged.

Thus, by reducing the average particle size of the developer carrier to smaller than the average particle size of the charging magnetic particle, the magnetic confining force to the developer carrier in the magnetic field in the charging region, is smaller than that to the charging magnetic particle. Therefore, the developer carrier mixed into the magnetic brush portion 3*c* of the magnetic brush charger 3, is easily discharged from the magnetic brush portion. The developer carrier is not accumulated in the magnetic brush 3*c* of the magnetic brush charger 3 for a long term, even if the untransferred toner is collected by the magnetic brush charger 3 and the two-component developer type developing device without the use of a cleaning device. Therefore, the good charging property can be maintained. Thus, small size image forming apparatus providing high image quality, can be accomplished.

The average particle size of the developer carrier is smaller than the average particle size of the charging magnetic particle, and therefore, the area where the developer carrier discharged from the magnetic brush charger to the photosensitive drum blocks the image exposure at an image exposure position is reduced, thus permitting formation of good latent images. Thus, small size image forming apparatus providing high image quality, can be accomplished.

In the foregoing, the photosensitive drum is charged to the negative polarity, and the reverse development type is used, but these are not limiting.

(Others)

1. The magnetic brush charger 3 is not limited for the use with the rotatable sleeve type as described above, but is applicable to a device wherein the magnet roller 3*b* rotates, to a device wherein the surface of the magnet roller 3*b* has an electric energy supply electrode provided by electroconductivity treatment, and the charging magnetic particle is magnetically confined on the surface to form and support the magnetic brush portion, the magnet roller being rotated. The present invention is applicable to a magnetic brush charger of non-rotatable type.
2. The charging bias applied to the magnetic brush charger 3 may be of DC only type (DC applying system), or may be an alternating voltage biased DC voltage (AC applying system).

The waveform of the alternating voltage in the AC applying type or the developing device 4 may be in the form of sinusoidal wave, rectangular wave, triangular wave or the like. The rectangular wave may be produced by periodically rendering ON and off a DC voltage. The alternating voltage may be a voltage whose voltage periodically changes.

3. The contact charging by the magnetic brush charger for the image bearing member is not limited to the charge injection charging type of the foregoing embodiments, but may be a type wherein the discharge phenomenon is mainly used.
4. As for the image exposure means for electrostatic latent image formation, is not limited to the laser scanning exposure means for forming a digital latent image as in the foregoing embodiments. It may be an usual analog image exposure means, or may use another light emission element such as LED. Fluorescent light emission element and liquid crystal shutter may be combined. It may be any one if it can form an electrostatic latent image corresponding to image information.

The image bearing member may by a dielectric member for electrostatic recording. In this case, the dielectric member surface is uniformly subjected to primary charging to a predetermined polarity and potential, and then, the surface is selectively discharged by discharging means such as discharging needle head, electronic gun or the like to form an intended electrostatic latent image.

5. The developing device 4 may be of two component non-contact development type. Regular developing system is usable, too.
6. The transfer device 7 is not limited to a roller transfer device as in the foregoing embodiments, it may be of a blade transfer type, another contact transfer charging type, or a type wherein a transfer drum or transfer belt or intermediate transfer member is used for superimposing image transfer, multi-color image transfer, or full-color image transfer.
7. The process cartridge 101 is not limited to the ones in the foregoing embodiment, but may be of any type.
8. The electrophotographic photosensitive member and the electrostatic recording dielectric member as the image bearing member, may be a rotation belt type, on which a toner image is formed-through charging, latent image formation and development. The toner image is displayed, and the belt is repeatedly used. The image forming apparatus includes such an image display device.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member;

charging means for charging said image bearing member, said charging means including magnetic field generating means and magnetic particles contactable to said image bearing member at a charging position;

developing means for developing with toner an electrostatic image formed on said image bearing member using said charging means, said developing means including carrier particles; and transferring means for transferring a toner image from said image bearing member onto a recording material, wherein said developing means is capable of collecting residual toner from said image bearing member, and wherein a magnetic confining force acting on said magnetic particles is larger than a magnetic confining force acting on said carrier particles under a magnetic field formed by said magnetic field generating means at the charging position.

2. An apparatus according to claim 1, wherein the saturation magnetization per one magnetic particle is larger than the saturation magnetization per carrier particle under the magnetic field.

3. An apparatus according to claim 1, wherein the magnetic particle have a density which is larger than the density of the carrier particles.

4. An apparatus according to claim 1, wherein the magnetic particle have an average particle size which is larger than the average particle size of the carrier particles.

5. An apparatus according to claim 1, wherein said charging means is supplied with a DC voltage not having an AC component.

6. An apparatus according to claim 1, wherein said charging means is supplied with an AC biased DC voltage.

7. An apparatus according to any one of claims 1–6, wherein said image bearing member has a surface layer having a volume resistivity of $10^9$–$10^{14}$ Ω.cm.

8. An apparatus according to claim 7, wherein said image bearing member has an electrophotographic photosensitive layer inside said surface layer.

9. A process cartridge detachably mountable relative to an image forming apparatus, said process cartridge comprising:

an image bearing member;

charging means for charging said image bearing member, said charging means including magnetic field generating means and magnetic particles contactable to said image bearing member at a charging position; and developing means for developing with toner an electrostatic image formed on said image bearing member using said charging means, said developing means including carrier particles, wherein said developing means is capable of collecting residual toner from said image bearing member, and wherein a magnetic confining force acting on said magnetic particles is larger than a magnetic confining force acting on said carrier particles under a magnetic field formed by said magnetic field generating means at the charging position.

10. An apparatus according to claim 9, wherein the saturation magnetization per one magnetic particle is larger than the saturation magnetization per one carrier particle under the magnetic field.

11. An apparatus according to claim 9, wherein the magnetic particle have a density which is larger than the density of the carrier particles.

12. An apparatus according to claim 9, wherein the magnetic particle have an average particle size which is larger than the average particle size of the carrier particles.

13. An apparatus according to claim 9, wherein said charging means is supplied with a DC voltage not having an AC component.

14. An apparatus according to claim 9, wherein said charging means is supplied with an AC biased DC voltage.

15. An apparatus according to any one of claims 9–14, wherein said image bearing member has a surface layer having a volume resistivity of $10^9$–$10^{14}$ Ω.cm.

16. An apparatus according to claim 15, wherein said image bearing member has an electrophotographic photosensitive layer inside said surface layer.

* * * * *

UNITED STATES PATENT AND TRADEMARK OFFICE

CERTIFICATE OF CORRECTION

PATENT NO. : 5,822,659
DATED : Oct. 13, 1998
INVENTOR(S) : Harumi Ishiyama

It is certified that error appears in the above-identified patent and that said Letters Patent is hereby corrected as shown below:

Please delete columns 1-18 and substitute columns 1-18 as per attached.

Signed and Sealed this

Sixth Day of March, 2001

*Attest:*

Nicholas P. Godici

NICHOLAS P. GODICI

*Attesting Officer*

*Acting Director of the United States Patent and Trademark Office*

IMAGE FORMING APPARATUS AND PROCESS CARTRIDGE DETACHABLY MOUNTABLE RELATIVE TO AN IMAGE FORMING APPARATUS

FIELD OF THE INVENTION AND RELATED ART

The present invention relates to an image forming apparatus such as a copying machine, a printer or a facsimile machine, using an image formation process such as electrophotographic or electrostatic recording processes, and to a process cartridge detachably mountable relative to the image forming apparatus.

In such an image forming apparatus, a toner image corresponding to intended image information is formed on an image bearing member, such as an electrophotographic photosensitive member or an electrostatic recording dielectric member, through an image formation process including a uniform charging process, an electrostatic latent image forming process and a developing process. The toner image is then transferred onto a recording material by a transfer device. The image bearing member after the transfer is repeatedly used for the image formation (image transfer type). It is preferable that a cleaning device exclusively for removal of the residual toner (untransferred toner) remaining after the toner image transfer onto the recording material, is not provided, but the developing means is used for the removal of such toner (simultaneous development and cleaning).

In a proposed image forming apparatus of the transfer type using a cleaner-less system, a contact charging device having a magnetic brush charger is used for charging the photosensitive member as the image bearing member in an electrophotographic apparatus. No independent cleaning device exclusively for the removal of the untransferred toner after the toner image transfer, is used. The untransferred toner is collected by a developing device.

The movement of the surface of the photosensitive member brings, to the developing device, the toner on the photosensitive member having passed through the charging region without being collected by the magnetic brush portion and the toner having passed through the charging region and having partly discharged from the magnetic brush portion onto the photosensitive member. The developing device collects such toner (simultaneous development and cleaning) using the DC voltage applied to the developing device at the time of the subsequent development and the potential difference Vback for removal of fog toner, which is the potential difference between the DC voltage applied to the developing device and the surface potential of the photosensitive member.

The magnetic brush charger includes a magnetic brush portion of charging magnetic particles (electroconductive magnetic particles) carried, by magnetic confinement, on a rotatable or non-rotatable supporting member which also functions as an electric energy supply electrode. A member to be charged (here, an image bearing member) is charged uniformly to a predetermined polarity and potential by application of a predetermined charging bias onto the supporting member while the magnetic brush portion contacts the image bearing member.

By temporarily collecting the untransferred toner into the magnetic brush portion of the magnetic brush charger, toner having a charge polarity which is reverted at the transfer portion, is charged to the regular charge polarity. Additionally, the untransferred toner pattern is scraped off, so the ghost image of the untransferred toner pattern is not produced.

Such an image forming apparatus is not provided with an independent cleaning device exclusively for removal of the untransferred toner from the surface of the photosensitive member after the toner image transfer onto the recording material, and therefore, the space saving advantage is significant to permit significant downsizing of the device. Additionally, the untransferred toner is finally collected back into the developing device and is reused for the next process, thus reducing the amount of the final residual toner. This is preferable from the standpoint of environmental health.

In image forming apparatuses, a corona charger has widely been used as a charging means for the image bearing member. More particularly, a corona charger is disposed facing the image bearing member without contact thereto, and a high voltage is applied thereto to produce a corona shower, to which the surface of the image bearing member is exposed, by which the surface is charged to the predetermined polarity and potential. Recently, however, a contact charging device has been widely used because of the advantage of the smaller amount of ozone product and because of the low voltage and the low electric power, or the like. With this charging system, an electroconductive member supplied with a predetermined charging bias (contact charging member such as a charging roller, charging blade, magnetic brush, fur brush or the like), contacts the surface of the image bearing member, by which the surface of the image bearing member is charged to a predetermined polarity and potential.

The above-described example of the cleanerless-type image forming apparatus uses a magnetic brush charger as the contact charging device for the image bearing member.

However, in such a cleanerless-type image forming apparatus as described above, if the developing device for visualizing the formed latent image into a toner image uses a two component developer comprising a toner (non-magnetic property) and a developer carrier (magnetic property), the developer carrier may be deposited on the image bearing member in a developing zone and may be carried over to the magnetic brush charger and may be introduced into the magnetic brush portion. When the image forming apparatus is subjected to long term use, quite a large amount of the developer carrier is accumulated in the magnetic brush portion of the magnetic brush charger.

The toner has a higher resistance than the charging magnetic particles constituting the magnetic brush portion of the magnetic brush charger. However, it has a much smaller particle size than the charging magnetic particles, and the magnetic confining force per one particle, and therefore, even if the untransferred toner is introduced into the magnetic brush portion of the magnetic brush charger, it is subsequently discharged therefrom with the result that the amount thereof accumulated in the magnetic brush portion is relatively small. Accordingly, the charging property of the magnetic brush charger is not substantially deteriorated. However, the developer carrier has a higher resistance than the charging magnetic particle, and in addition, it has a particle size which is comparable to the charging magnetic particles, and the magnetic confining force per one particle is large, with the result that it is not easily discharged from the brush. The accumulated amount of the developer carrier particles in the magnetic brush portion of the magnetic brush charger gradually increases, and the resistance value of the entirety of the magnetic brush portion gradually increases, accordingly. Then, the charging property of the magnetic brush charger deteriorates. Because of this, the output image quality deteriorates (image quality defect).

In the case of an image forming apparatus provided, between the transfer device and the magnetic brush charger, with a cleaning device exclusively for removing the untransferred toner from the surface of the photosensitive member after the toner image transfer to the recording material in the transferring device, the developer carrier, if any, deposited on the photosensitive member in the developing zone, is removed from the surface of the photosensitive member by the cleaning device before the magnetic brush charger. Therefore, the apparatus is free of the problem of the deterioration of the charging property resulting from the accumulation of the developer carrier in the magnetic brush portion of the magnetic brush charger.

SUMMARY OF THE INVENTION

Accordingly, it is a principal object of the present invention to provide an image forming apparatus and a process cartridge which prevent the deterioration of the charging property due to introduction of the developer carrier into the magnetic powder or particles of the charging means.

It is another object of the present invention to provide an image forming apparatus and a process cartridge wherein the developer carrier is easily discharged from the magnetic powder of the charging means.

It is a further object of the present invention to provide an image forming apparatus and a process cartridge, which prevent the deterioration of image quality due to the introduction of the developer carrier into the magnetic powder of the charging means.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIG. 1 is a schematic illustration of an image forming apparatus of a cleanerless type according to embodiment 1 of the present invention.

FIG. 2 shows a schematic layer structure of a photosensitive drum as an image bearing member.

FIG. 3 shows a structure of a magnetic brush charger.

FIG. 4 is a schematic view of a developing device.

DESCRIPTION OF THE PREFERRED EMBODIMENTS

First Embodiment (1) Structure of an Example of an Image Forming Apparatus

FIG. 1 is a schematic view of an example of an image forming apparatus according to Embodiment 1 of the present invention.

The image forming apparatus of this example is a detachable process cartridge-type laser beam printer using an image transfer type electrophotographic process.

A charging device for the image bearing member (photosensitive member) is a contact charging device using a magnetic brush charger, and a developing device uses a two component developer comprising a developer carrier and a toner and functions to collect residual toner from the image bearing member (cleaner-less system).

Designated by A is a laser beam printer, and designated by B is an image reader or scanner for reading an image, placed on the printer.

a. Image Reading Device B

In the image reading device B, designated by 10 is an original supporting platen glass fixed on the upper surface of the device, and an original G to be copied is placed face down on the top surface of the original supporting platen glass, and is covered by an unshown original cover.

Designated by 9 is an image reading unit including an original illumination lamp 9*a*, a short focus lens array 9*b*, CCD sensor 9*c* and the like. The unit 9, upon actuation of an unshown copy key, is moved forward along a bottom surface of the glass from its home position at the right-hand portion, and upon arrival at a predetermined forward movement end portion, it is moved backward to the home position.

During the forward movement driving stroke of the unit 9, the image surface of the set original G on the original supporting platen glass 10 is illuminated and scanned from the right-hand side to the left-hand side by the original projection lamp 9*a* of the unit 9, and the light reflected by the surface of the original is imaged on a CCD sensor 9*c* by the short focus lens array 9*b*.

CCD sensor 9*c* includes a light receiving portion, a transfer portion and an output portion. A light signal is converted to a charge signal by the light receiving CCD portion, and the charge signal is transferred to an output portion in synchronization with clock pulses by a transfer portion. In the output portion, the charge signal is converted to a voltage signal, which is then amplified with impedance reduction treatment, and the resultant signal is outputted. The analog signal provided in this manner, is subjected to known image processing, so that a digital signal is produced and is fed to the printer A.

Namely, the image reading device B carries out photoelectric reading of the image information of the original G and conversion thereof to a time series electrical digital pixel signal (image signal).

b. Printer A

In the printer A, designated by 1 is an electrophotographic photosensitive member (photosensitive drum) of a rotatable drum type as an image bearing member. The photosensitive drum 1 is rotated about its axis at a predetermined peripheral speed (process speed), more particularly, at the rotational speed 150 mm/s in this example, in a clockwise direction a indicated by the arrow. During the rotation, it is subjected to discharging exposure by a pre-exposure lamp, and is then subjected to uniform charging of a negative (in this embodiment) by a magnetic brush charger 3.

The thus charged surface of the photosensitive member 1 is exposed to and scanned by a laser scanner 100 having an intensity modulated in accordance with an image signal fed to the printer A from the image reading device B, corresponding to the intended image information, so that electrostatic latent image thereof is formed in accordance with the image signal.

The formed electrostatic latent image on the surface of the rotatable photosensitive drum 1 is developed sequentially into a toner image by the developing device 4. In this embodiment, a reverse development system is used wherein the low potential portion of the latent image comprising high potential and low potential portions, receives the toner.

On the other hand, a recording material (transfer material) P accommodated in a sheet feeding cassette 11 is fed out by sheet feeding rollers 12 one by one, and is fed into the printer A. It is fed to the transfer portion 5*a* in the form of a contact nip between the photosensitive drum 1 and a transfer roller 5 as a transferring means at a predetermined controlled timing by registration rollers 13. The transfer roller 5 is supplied with a transfer bias of a polarity opposite from that of the toner from the transfer bias application voltage source S3 at a predetermined controlled timing so that the toner image is electrostatically transferred from the surface of the photosensitive drum 1 onto a surface of the recording material P fed into the transfer portion 5a.

The recording material P having received the toner image at the transfer portion 5a is then separated sequentially from the surface of the photosensitive drum 1, and is fed by a feeding device 14 to a fixing device 6, where the toner image is heated and fixed on the recording material. Then, the recording material is discharged as a copy or a print.

The untransferred toner remaining on the surface of the rotatable photosensitive drum 1 after the toner image transfer onto the recording material P, is brought to the position of the magnetic brush charger 3 by the continued rotation of the photosensitive drum 1, and is temporarily collected by the magnetic brush portion (simultaneous charging and cleaning). The photosensitive drum 1 is charged by the charger 3 while the residual toner passes by the magnetic brush charger 3, and while the toner is discharged from the magnetic brush charger 3 to the photosensitive drum 1. The area of the photosensitive drum 1 where the toner is present, is subjected to the image exposure operation so that electrostatic latent image is formed, and then is subjected to the simultaneous development and cleaning operation by the developing device 4. For the simultaneous development and cleaning operation, a developing sleeve of the developing device 4 is supplied with a bias voltage having a voltage level which is between the potentials of the high potential portion and the low potential portion of the electrostatic latent image, so that toner is transferred from the developing sleeve to the low potential portion, and simultaneously therewith, the residual toner is collected from the high potential portion to the developing sleeve.

(2) Process Cartridge 101

Designated by 101 is a process cartridge which is detachably mountable relative to a predetermined portion in a main assembly of the printer. In the apparatus of this example, the photosensitive drum 1 as the image bearing member, the magnetic brush charger 3 and the developing device 4 (three process means), are mounted in a cartridge casing with a predetermined mutual disposition relationship, so that process cartridge is constituted.

The process cartridge 101 is mounted to a predetermined portion in the main assembly of the printer, by which the process cartridge 100 and the main assembly of the printer are mechanically and electrically coupled with each other, and the image forming operation of the printer is enabled. Designated by 102 are members for guiding and supporting the process cartridge 101. The cartridge 101 may contain the photosensitive drum 1 and at least one of the charger 3 and the developing device 4.

(3) Photosensitive Drum 1

As for the material of the image bearing member, organic photosensitive member (OPC) is usable, which is normally used for a photosensitive drum 1. Desirably, it is a photosensitive member having an outermost charge injection layer of low resistance, or an amorphous silicon photosensitive member or the like which has a surface layer having a resistance of $10^9$–$10^{14}$ Ω.cm. Then, the charge injection charging is usable with the advantage of small ozone production, so that its charging property is improved.

In this example, the photosensitive member 1 is an organic photosensitive member having a surface charge injection layer in which electroconductive particles ($SnO_2$) are dispersed to provide a volume resistivity of $10^{13}$ Ω.cm approximately.

In other words, the photosensitive drum 1 of this example is a negatively chargeable OPC photosensitive member having a surface charge injection layer, and has, on an aluminum drum base having a diameter of 30 mm, the following five function layers. FIG. 2 is a schematic view of the layers.

From the aluminum drum base $1_1$ side, there are a primer layer $1_2$ as a first layer, a positive charge injection preventing layer $1_3$ as a second layer, a charge generating layer $1_4$ as a third layer, a charge transfer layer $1_5$ as a fourth layer, and a charge injection layer $1_6$ as a fifth layer, in the order named. The first layer to fourth layer are used in a usual OPC photosensitive member of the functionally-separated type. It may be in the form of a monolayer type OPC, ZnO, selenium, amorphous silicon or the like photosensitive member.

The fifth layer (surface layer) (charge injection layer $1_6$) of this example comprises acrylic resin material of photocuring type as a binder resin material, and $SnO_2$ ultra-fine particles $1_6$ as electroconductive particles (electroconductive filler) dispersed therein. More particularly, the $SnO_2$ particles having an average particle size of approximately 0.03 μm, which have been subjected to low resistance treatment by doping antimony, are dispersed in the resin material at a ratio of 5:3 by weight. Furthermore, charging magnetic particles for constituting the magnetic brush layer of the magnetic brush charging equipment 3, and fine particles of tetrafluoroethylene resin material (PTFE: tradename of Teflon, available from Dupont) having an average particle size of 0.3 μm, are dispersed therein. The ratio thereof in total is 33% by weight. The tetrafluoroethylene resin material is effective to improve the parting property. The coating liquid as described above is applied through dip coating or the like into a thickness of approximately 3 μm to provide the charge injection layer $1_6$.

Actually, the volume resistivity of the charge injection layer $1_6$ changes with the dispersion amount of the electroconductive $SnO_2 1_6$a. To prevent production of image flow, the resistance value of the charge injection layer $1_6$ is preferably not less than $1\times10^8$ Ω.cm.

The resistance value of the charge injection layer $1_6$ is measured in the following manner. The charge injection layer is applied or painted on an insulative sheet, and the surface resistance thereof is measured using a high resistance meter 4329A available from Hewlett-Packard, with the applied voltage of 100 V. In this example, the volume resistivity of the charge injection layer $1_6$ was $1\times10^{12}$ Ω.cm.

(4) Magnetic Brush Charger 3

FIG. 3 is an illustration of the magnetic brush charger 3. The magnetic brush charger 3 is of a rotatable sleeve type, and comprises a sleeve (charging sleeve) 3a of non-magnetic and electroconductive material having an outer diameter of 20 mm, a magnet roller 3b as a magnetic field generating means disposed stationarily in the sleeve, and a magnetic brush portion 3c of charging magnetic particles (electroconductive magnetic particles) magnetically attracted on the outer peripheral surface of the charging sleeve 3a by the magnetic force provided by the magnet roller 3b. The magnetic brush portion 3c contacts the surface of the photosensitive drum 1 to constitute a charging station or portion, namely a charging nip or charging region.

The charging sleeve 3a is rotated in the direction for counterdirectional peripheral movement relative to the photosensitive drum 1 at the contact portion n with the photosensitive drum 1. More particularly, the photosensitive drum 1 is rotated at a peripheral speed of 150 mm/sec, and the charging sleeve 3a is rotated at the peripheral speed of 225 mm/sec. By the rotation of the charging sleeve 3a, the magnetic brush portion 3c is rotated to rub the surface of the photosensitive drum 1.

The magnetic flux density at the charging sleeve surface in the closest position between the photosensitive drum 1 and the charging sleeve 3*a*, is 1000 Gauss. The width of the magnetic brush portion 3*c* is 300 mm, and the charging magnetic particle amount constituting the magnetic brush portion 3*c* is approximately 40 g, and the gap between the charging sleeve 3*a* and the photosensitive drum 1 is approximately 500 μm at the nip.

The charging sleeve 3*a* of the magnetic brush charger 3 is supplied with a predetermined charging bias from a charging bias voltage source S1, so that electric energy supply occurs to the photosensitive drum 1 in the charging portion n through the magnetic brush portion 3*c*, by which the surface of the photosensitive drum 1 is uniformly charged to the polarity and the potential substantially corresponding to the DC voltage component (DC bias component) of the applied charging bias (charge injection charging system, in this example).

With respect to the rotational speed of the charging sleeve 3*a*, the charging uniformity tends to increase with an increase of the speed.

In the case of the charge injection charging type, the photosensitive drum potential of −700 V is provided when the DC charging bias voltage is −700 V. In this image forming apparatus, wherein the untransferred toner is mixed into the magnetic brush portion 3*c*, the magnetic brush charger 3 is supplied with an AC biased DC charging bias, which comprises a DC voltage of −700 V, and an alternating voltage (AC bias) which has a frequency Vf of 1000 Hz, and an amplitude (peak-to-peak voltage) Vpp of 1000 V. With these values, a satisfactory charging property is provided. The charging bias applied to the magnetic brush charger 3 is not limited to the above-described one, but may be properly selected by one skilled in the art.

As regards the particle size of the charging magnetic particle, it is preferably small from the standpoint of uniform charging, but if it is too small, the charging magnetic particle deposition to the photosensitive drum 1 occurs because of the relation between the magnetic force and the particle size. The number average particle size of the charging magnetic particles is preferably 10–100 μm, and 10–50 μm is further preferable from the standpoint of the uniform charge, and even further preferably, it is 15–50 μm from the standpoint both of uniform charging and the prevention of charging magnetic particle deposition. If the charging magnetic particle size exceeds 100 μm, the specific surface area with which the magnetic brush rubs the photosensitive drum, decreases with the result of insufficient charging, and a trace of brushing, due to the magnetic brush of the charging magnetic particle, is produced in the image, and therefore, a range higher than that is not preferable from the standpoint of uniform charging. If it is smaller than 15 μm, the magnetic force of one charging magnetic particle is small resulting in a higher tendency of charging magnetic particle deposition. The particle size measuring method for the magnetic particle powder will be described hereinafter.

As regards the resistance value of the magnetic particle, if it is too high, the charge cannot be uniformly injected into the photosensitive drum with the result of foggy images due to improper charging in small areas. If it is too low, the current concentratedly flows through a pin hole, if any, in the photosensitive drum surface with the result of a charge potential drop, so that the photosensitive drum surface is not charged, and therefore, the uneven charging in the form of the charging nip occurs. Accordingly, the resistance value of the magnetic particle is preferably $1\times10^5$–$1\times10^8$ Ω.cm. The resistance value of the magnetic particle is measured in the following manner: 2 g of the magnetic particle is placed in a metal cell having a bottom surface area of 228 $mm^2$ to which a voltage is applicable, and then the load of 6.6 $kg/cm^2$ is applied, and the current is measured when a voltage of 100 V is applied.

The charging magnetic particles used in this example were ferrite particles of the following properties:

Average particle size: 30 μm

Saturation magnetization at 1000 Gauss: 280 $emu/cm^3$

Resistance: $6\times10^7$ Ω.cm

In the charge injection charging, it is preferable that charge injection is effected (the charge is directly injected into an electronic unit in the outermost layer) into the surface of the member to be charged (photosensitive member) having an intermediate surface resistance by a contact charging member having an intermediate resistance. In this example, the charge is not injected to the trap potential in the photosensitive member surface material, but the charging is effected to the electroconductive particle $1_6$a ($SnO_2$) of the charge injection layer $1_6$. The charging model thereof is such that charging is effected by the contact charging member 3 to a fine capacitor constituted by a dielectric member, which is the charge transfer layer $1_5$ and both electrode plates one of which is the drum fundamentals $1_1$ of aluminum and the other of which is the electroconductive particle $1_6$a in the charge injection layer $1_6$. Here, the electroconductive particles $1_6$a are electrically independent from each other, and therefore, they each constitute a kind of fine float electrode. Therefore, the photosensitive member surface seems to be charged to a uniform potential, macroscopically, but the fact is as if a great number of charged fine electroconductive particles of $SnO_2$ covers the photosensitive member surface. Accordingly, even if the image exposure L is carried out, the electrostatic latent image can be retained, since the respective $SnO_2$ particles $1_6$a are electrically independent from each other.

(5) Developing Device 4

FIG. 4 is a schematic view of the developing device 4 of the two-component contact type developing type (two-component magnetic brush type development) used in this example.

Designated by 41 is a developing container; 42 denotes a developing sleeve as the developer carrying member, 43 denotes a magnet roller as a magnetic field generating means stationarilly fixed in the developing sleeve 42; 44 denotes a developer layer thickness regulating blade for forming a thin layer of the developer on developing sleeve surface; 45 denotes a developer stirring and feeding screw; 46 denotes the two component developer accommodated in the developing container 41, which comprises non-magnetic toner particles t and magnetic carrier particles (developer carrier) c mixed therewith. Designated by 47 is a toner supplying portion.

The developing sleeve 42 is so disposed that at least at the time of the development operation, it is placed with the closest distance from the photosensitive drum 1 being approximately 500 μm, so that magnetic developer brush thin layer 46*a* on the outer surface of the developing sleeve 42 contacts the surface of the photosensitive drum 1. The contact portion between the magnetic developer brush thin layer 46*a* and the photosensitive drum 1 is a developing zone (developing zone).

The developing sleeve 42 is rotated around the stationary magnet roller 43 in the counterclockwise direction indicated by the arrow at a predetermined rotational speed. In the developing container 41, a magnetic brush of the developer 46 is formed on the outer surface of the sleeve by the magnetic force of the magnet roller 43. The magnetic developer brush is fed with the rotation of the sleeve 42, and is subjected to layer thickness regulation by the blade 44 so as to be a magnetic developer brush thin layer 46*a* having a predetermined layer thickness, and is carried out of the developing container to the developing zone. It contacts the surface of the photosensitive drum 1, and is returned into the developing container 41 by the continuing rotation of the sleeve 42.

Between the developing sleeve 42 and the electroconductive drum base of the photosensitive drum 1, a developing bias in the form of a DC voltage plus alternating voltage, is applied from a developing bias applying voltage source S2.

In this example, the developing bias voltage is as follows:

DC voltage: −500 V

Alternating voltage:

amplitude Vpp=1500 V, and frequency Vf=2000 Hz

In the developing zone, the toner t in the magnetic developer brush thin layer 46*a* at the developing sleeve 42 side is selectively deposited to the drum in accordance with the electrostatic latent image thereon, so that electrostatic latent image is developed into the toner image.

Generally, the application of the alternating voltage is effective to increase the development efficiency so that image quality is improved in the two-component developer type developing method, but fog tends to be produced. Therefore, a potential difference is provided between the DC voltage applied normally to the developing device 4 and the surface potential of the photosensitive drum 1, by which the fog production is prevented.

The toner content in the developer 46 in the developing container 41 (mixture ratio relative to the carrier) gradually decreases by the consumption of the toner to develop the electrostatic latent image. The toner content in the developer 46 in the developing container 41 is detected by unshown detecting means. When it decreases to a predetermined level, the toner supply is carried out from a toner supplying portion 47 into the developer 46 in the developing container 41 to maintain a predetermined permissible range of the toner content in the developer 46 in the developing container 41 (toner supply control).

Description will be provided as to a circulating system for the developer in the developing device 4. The developer 46 is taken up on the sleeve by $N_3$ pole of the magnet roller 43 with rotation of the developing sleeve 42, and is moved by $S_2$ pole and $N_1$ pole. Then, the developer is regulated by a regulating blade 44 disposed perpendicularly to the developing sleeve 42 so that thin layer 46*a* of the developer 46 is formed on the developing sleeve. The developer layer 46*a* thus formed in the thin layer is fed to the position of the main developing pole $S_1$ in the developing zone, where it is reformed as chains of developer by the magnetic force. The electrostatic latent image on the photosensitive drum 1 is developed into a toner image by the developer layer 46*a* in the form of chains. The residual toner remains on the photosensitive drum 1, and is temporarily collected by the magnetic brush portion 3*c* of the magnetic brush charger 3 as the contact charging member, and is charged to the regular polarity (negative). The toner is then discharged to the drum 1, and is collected back into the developer layer 46*a* on the developing sleeve 42. Thereafter, t' developer on the developing sleeve 42 is returned into developing container 41 by a repellent magnetic fielc ·ided by the $N_2$ pole and the $N_3$ pole.

The two component developer usec ·s embodiment comprises:

Toner particles t: negative charged toner powder manufactured through a pulverization method and having an average particle size of 6 μm added with oxide titanium particles having an average particle size of 20 nm (weight ratio of 1%).

Carrier c: magnetic carrier powder having an average particle size of 30 μm and a saturation magnetization of 130 emu/cm$^3$ at 1000 Gauss.

The toner and carrier were mixed at a weight ratio of 7:93.

Here, a description will be provided as to a measuring method of the toner particle size distribution.

The used measuring device was Coaltar counter TA-2 type, available from Coaltar, to which an interface, available from Nikkaki Kabushiki Kaisha, for outputting a number average distribution and volume average distribution, to which a CX-1 personal computer, available from Canon Kabushiki Kaisha, is connected. An NaCl aqueous solution (1%) was prepared using first class chloride sodium an as electrolytic solution.

Into the electrolytic aqueous solution 100–150 ml, surfactant as dispersion material, preferably 0.1–5 ml of alkylbenzensulfonate is added, and also, 0.5–50 mg of the measurement sample is added.

The electrolytic solution containing the suspended sample is subjected to a dispersion process by an ultrasonic dispersion device for approximately 1–3 minutes, and the particle size distribution of the particles having the sizes of 2–40 μm is measured using the Coaltar counter TA-2 type and a 100μ aperture, and the volume average distribution is determined. The volume average particle size is obtained from the volume average distribution thus determined.

(6) Transfer Device 7

In this example, the transferring means is in the form of a transfer roller 7, which is contacted to the photosensitive drum 1 to form a nip as a transfer portion 7*a*.

The transfer roller 8 of this example comprises a core metal of an electroconductive rigid material such as metal and having an outer diameter of 8 mm, and an electroconductive elastic layer of a foamed elastic member produced by dispersing an electroconductive material such as carbon in urethane, EPDM (ethylenepropylenediene rubber) or the like to provide a resistance value of $10^5$–$10^{10}$ Ω.cm and an Asker C hardness approximately of 20–50 degrees. The outer diameter is 16 mm, and the roller is driven by the rotation of the photosensitive drum 1 at the same peripheral speed as the drum. During the transfer operation, the core metal of the transfer roller 7 is supplied with a transfer bias (DC voltage of approximately +4 kV) from a transfer bias application voltage source S3. Between the photosensitive drum 1 and the transfer roller 7, a transferring electric field is formed in the direction of transferring the negative polarity toner particles forming the toner image onto the recording material P, by electrostatic transfer.

(7) Charging Magnetic Particle and Developer Carrier a) The surface of the photosensitive drum 1 carries untransferred toner thereon after the toner image transfer to the recording material P. The untransferred toner is, as has been described hereinbefore, passed by the magnetic brush portion 3*c* of the magnetic brush charger 3 and is temporarily collected (simultaneous charging and cleaning). In addition, the toner discharged from the magnetic brush portion 3*c* is collected by the developing device 4 (simultaneous development and cleaning).

b) On the other hand, the developer carrier in the developing device 4 may be deposited onto the surface of the photosensitive drum 1 in the developing zone; may then be carried over to the magnetic brush charger 3 with the rotation of the photosensitive drum 1; and may then be mixed into the magnetic brush 3c.

The developer carrier of the two component developer is effective to charge the toner to the negative polarity in this example by rubbing with the toner in the developing device, and therefore, the developer carrier per se is charged to the positive polarity. So, in the developing zone, the developer carrier deposited on the photosensitive member 1 is charged to the positive polarity. The carrier particles are hardly transferred onto the recording material P by the transferring electric field provided by the positive transfer bias, which is applied to the transfer roller 7 for the electrostatic transfer of the negative charged toner onto the recording material P. Therefore, they remain deposited on the photosensitive drum 1, and are carried over to the magnetic brush charger 3 and are mixed into the magnetic brush portion 3c.

c) In order to positively charge the toner through triboelectricity, the developer carrier has a higher resistance than the charging magnetic particle, and therefore, if the developer carrier is mixed into the magnetic brush portion 3c of magnetic brush charger 3 and is accumulated there, the charging property of the magnetic brush portion 3c deteriorates.

d) In this example, in order to discharge the mixed developer carrier if any from the magnetic brush portion 3c, the charging magnetic particles and the developer carrier for constituting the magnetic brush portion 3c, have the following properties.

(1) Charging Magnetic Particle

Average particle size: 30 μm

Volume resistivity: $6\times10^{7}$ Ω.cm

Saturation magnetization at 1000 Gauss: 280 emu/cm$^3$

Density: 5.2 g/cm$^3$

Material: ferrite particle (2) Developer Carrier

Average particle size: 30 μm

Volume resistivity: $9\times10^{13}$ Ω.cm

Saturation magnetization at 1000 Gauss: 130 emu/cm$^3$

Density: 3.5 g/cm$^3$

Material: resin material carrier

The charging magnetic particle and the developer carrier are imparted by a magnetic confining force toward the charging sleeve 3a and the electrostatic force toward the photosensitive drum 1 by the magnetic field of the magnet roller 3b, respectively. The electrostatic force significantly varies in accordance with deterioration by long term use or by ambient conditions, such as temperature and/humidity, around the device. In this embodiment, at least the developer carrier is discharged from the charging magnetic brush during the operation of the apparatus, by providing different magnetic confining forces, the magnetic confining force being stable as compared with the electrostatic force.

More particularly, the magnetic confining force Fr in the direction toward the charging sleeve (or a direction in a polar co-ordinate system with the point of origin being the center of the charging sleeve)

$$|\vec{F}r|=(\partial/\partial r)M\cdot|\vec{B}|$$

$$=M\cdot(\partial/\partial r)|\vec{B}|$$

M is magnetization of one particle=$\sigma v\cdot 4/3\cdot\pi\cdot d^3$,

σv=magnetization per unit volume (equivalent to the saturation magnetization under 1000 Gauss), d=particle size of the particle, $|\vec{B}|$=absolute value of external magnetic field in charging region, $(\partial/\partial)|\vec{B}|$ absolute value of change rate of the external magnetic field toward the charging sleeve center.

Adjacent the surface of the magnetic brush in the charging region n, the external magnetic field acting on the charging magnetic particle and the external magnetic field acting on the developer carrier are substantially the same, and therefore, using a different magnetization per unit particle 1 is effective as a means for providing a different magnetic confining force. By this, even if there is a variation in the electrostatic force, the magnetic confining force of the charging magnetic particle is kept always larger than that of the developer carrier. When the device is used for the long term, the developer carrier tends to be discharged onto the photosensitive drum from the charging magnetic brush, and as a result, the amount of the developer carrier accumulated in the magnetic brush decreases. Thus, the charging magnetic brush can maintain its stabilized charging property.

The magnetization per one particle 1 of the charging magnetic particles used in this embodiment is $40\times10^{-6}$ emu, and the magnetization of the developer carrier is $1.8\times10^{-6}$ emu.

The developer carrier discharged onto the photosensitive drum 1 from the magnetic brush portion 3c is carried to a developing device 4 in accordance with the continued rotation of the photosensitive drum 1. It is subjected to magnetic confinement to the developing sleeve 42 by the magnetic field of the magnet roller 43 in the developing sleeve 42, and is collected.

Namely, the mixed development carrier is discharged from the magnetic brush portion 3c, and is collected by the developing device 4, so that it is prevented from accumulating in the magnetic brush portion 3c.

Actually, when 10,000 image formations were carried out, no improper charging due to the accumulation of the developer carrier in the magnetic brush portion 3c of the magnetic brush charger 3, was observed, and good images were formed continuously.

e) Operation of a comparison example was carried out, wherein the saturation magnetizations per one particle of the charging magnetic particles and the developer carriers under the magnetic field in the charging region n, are the same (3) and (4), as contrasted with (1) and (2), and the other conditions are the same as above. When 5,000 image forming operations were carried out, an image defect was observed, which is attributable to the improper charging due to the accumulation of the developer carrier in the magnetic brush portion 3c.

(3) Charging Magnetic Particle

Average particle size: 30 μm

Volume resistivity: $6\times10^{7}$ Ω.cm

Saturation magnetization at 1000 Gauss: 280 emu/cm$^3$

Material: ferrite particle (4) Developer Carrier

Average particle size: 30 μm

Volume resistivity: $9\times10^{13}$ Ω.cm

Saturation magnetization at 1000 Gauss: 280 emu/cm$^3$

Material: coated carrier f) Experiments were performed on the difference in the magnetic confining force between the charging magnetic particle and the developer carrier.

The same amount (approximately 1 g) of the charging magnetic particle and the developer carrier are placed on a non-magnetic flat plate. A magnet for providing an external magnetic field close to the charging region n, is provided, and the magnet is moved until the magnetic field in the charging region n is obtained. The difference in the magnetic confining force was confirmed depending on whether the particle is deposited or not. Most of the charging magnetic particles were deposited to the magnet before the magnetic field of the charging region is reached. Only approximately 10% of the developer carrier is deposited to the magnet, and the rest (90%) remains on the flat plate. Here, % is on the basis of weight.

Since a large amount of the toner is present in the developing device, the developer carrier is hardly deposited onto the drum 1 because of the electrostatic deposition to the drum 1 by the toner. In a few cases wherein images consuming a large amount of the toner are continuously formed, the amount of the toner decreases with the result that the developer carrier may be deposited onto the drum 1.

g) A description will be provided as to a measuring method for the average particle size, the resistance value and the magnetic property of the charging magnetic particle and the developer carrier particle.

(1) Average particle size

More than 100 particles are randomly extracted using an optical microscope or a scanning type electron microscope, and the volume particle size distribution is calculated with the maximum angular distance in the horizontal direction, and the average particle size is defined as the 50% average particle size thereof. Alternatively, use may be made of a laser diffraction type particle size distribution measuring device HEROS, available from Nippon Denshi KABUSHIKI KAISHA, and a range of 0.05 μm–200 μm is divided into 32 sections, which are then measured thereby. The average particle size may be defined as the 50% average particle size of the volume distribution.

(2) Resistance value

The resistance value of the particle is measured as follows: 2 g of the particle is filled in a cylindrical container having a bottom surface area of 227 $mm^2$, and it is pressed at 6.6 $Kg/cm^2$; then, the voltage of 100 V is applied in a vertical direction, the resistance is calculated and regularized from the current.

(3) Magnetic property

For the magnetic property measurement of the particle, an automatic DC magnetization B-H property recording device BH-50, available from Riken Denshi Kabushiki Kaisha, is usable. The particles are filled into a cylindrical container having a diameter (inner diameter) 6.5 mm and height 10 mm, at approximately 2 g, and the motion of the particle in the container is prevented. The saturation magnetization is measured from the B-H curve. In order to measure the magnetization of the magnetic particle in the charging region n, particularly, the external magnetic field comparable to that in the charging region is produced, and the measurement is then effected. The magnetic field in the charging region in this embodiment is 1000 Gauss, and therefore, the saturation magnetization at 1000 Gauss is used.

h) The saturation magnetization of the charging magnetic particle is made larger than the saturation magnetization of the developer carrier in this manner, the magnetic confining force to the developer carrier in the magnetic field in the charging region, is made smaller than that to the charging magnetic particle, so that the developer carrier introduced into the magnetic brush portion 3c of the magnetic brush charger 3 is not easily discharged from the magnetic brush portion. Therefore, the developer carrier is prevented from accumulating in the magnetic brush 3c of the magnetic brush charger 3, and therefore, a good charging property can be maintained, for the long term, even if there is no cleaning device exclusively therefor, and the untransferred toner is collected by the magnetic brush charger 3 and the two-component developer type developing device 4. Thus, a small size image forming apparatus providing high image quality, can be accomplished.

Second Embodiment

This embodiment, is different from the first embodiment, only in that the average particle size of the developer carrier is made smaller than the average particle size of the charging magnetic particle. By doing so, the mixed development carrier is discharged from the magnetic brush portion 3c even if the developer carrier is mixed into the magnetic brush portion 3c of the magnetic brush charger 3.

The charging magnetic particle and the developer carrier used in this example have the following properties.

(1) Charging magnetic particle

Average particle size: 30 μm

Volume resistivity: $6\times10^7$ Ω.cm

Saturation magnetization at 1000 Gauss: 280 $emu/cm^3$

Material: ferrite particle (2) Developer carrier

Average particle size: 20 μm

Volume resistivity: $9\times10^{13}$ Ω.cm

Saturation magnetization at 1000 Gauss: 280 $emu/cm^3$

Material: coated carrier

The device structure, the set conditions and the like are the same as with the first embodiment, and therefore, a detailed description thereof is omitted for simplicity.

Actually, when 20,000 image formations were carried out, no improper charging due to the accumulation of the developer carrier in the magnetic brush portion 3c of the magnetic brush charger 3, was observed.

The deposition of the charging magnetic particle and the developer carrier are measured through the same deposition amount measuring method as in Embodiment 1, and it was confirmed that most of the charging magnetic particles were deposited on the magnet, but only 7 weight % of the developer carriers were deposited thereon, and the rest, namely, 93 weight % remained.

The magnetic confining force is proportional to the volume of the particle, and therefore, the magnetic confining force becomes 30% by reducing the particle size of the developer carrier from 30 μm to 20 μm, and therefore, the developer carrier mixed into the magnetic brush portion 3c of the magnetic brush charger 3 is very easily discharged.

Thus, by reducing the average particle size of the developer carrier to smaller than the average particle size of the charging magnetic particle, the magnetic confining force to the developer carrier in the magnetic field in the charging region, is smaller than that to the charging magnetic particle. Therefore, the developer carrier mixed into the magnetic brush portion 3c of the magnetic brush charger 3, is easily discharged from the magnetic brush portion. The developer carrier is not accumulated in the magnetic brush 3c of the magnetic brush charger 3 for the long term, even if the untransferred toner is collected by the magnetic brush charger 3 and the two-component developer-type developing device without the use of a cleaning device. Therefore, a good charging property can be maintained. Thus, a small size image forming apparatus providing high image quality, can be provided.

The average particle size of the developer carrier is smaller than the average particle size of the charging magnetic particle, and therefore, the area where the developer carrier discharged from the magnetic brush charger to the photosensitive drum blocks the image exposure at an image exposure position is reduced, thus permitting formation of good latent images. Thus, a small size image forming apparatus providing high image quality, can be provided.

In the foregoing, the photosensitive drum is charged to the negative polarity, and the reverse development type is used, but these are not limiting.

Others

1. The magnetic brush charger 3 is not limited for the use with the rotatable sleeve type as described above, but is applicable to a device wherein the magnet roller 3*b* rotates, to a device wherein the surface of the magnet roller 3*b* has an electric energy supply electrode provided by electroconductivity treatment, and the charging magnetic particle is magnetically confined on the surface to form and support the magnetic brush portion, the magnet roller being rotated. The present invention is applicable to a magnetic brush charger of a non-rotatable type.

2. The charging bias applied to the magnetic brush charger 3 may be of a DC-only-type (DC applying system), or may be an alternating voltage biased DC voltage system (AC applying system).

The waveform of the alternating voltage in the AC-applying-type system or the developing device 4 may be in the form of a sinusoidal wave, a rectangular wave, a triangular wave or the like. The rectangular wave may be produced by periodically rendering on and off a DC voltage. The alternating voltage may be a voltage whose voltage periodically changes.

3. The contact charging by the magnetic brush charger for the image bearing member is not limited to the charge injection charging type of the foregoing embodiments, but may be a type wherein the discharge phenomenon is mainly used.

4. As for the image exposure means for electrostatic latent image formation, it is not limited to the laser scanning exposure means for forming a digital latent image as in the foregoing embodiments. It may be a usual analog image exposure means, or it may use another light emission element, such as an LED. Also, a fluorescent light emission element and a liquid crystal shutter may be combined. It may be any one of these if it can form an electrostatic latent image corresponding to image information.

The image bearing member may by a dielectric member for electrostatic recording. In this case, the dielectric member surface is uniformly subjected to primary charging to a predetermined polarity and potential, and then, the surface is selectively discharged by discharging means, such as a discharging needle head, an electronic gun or the like, to form an intended electrostatic latent image.

5. The developing device 4 may be of a two component non-contact development-type. A regular developing system is usable, too.

6. The transfer device 7 is not limited to a roller transfer device as in the foregoing embodiments. It may be of a blade transfer-type, another contact transfer charging-type, or a type wherein a transfer drum or transfer belt or intermediate transfer member is used for superimposing image transfer, multi-color image transfer, or full-color image transfer.

7. The process cartridge 101 is not limited to the ones in the foregoing embodiment, but may be of any type.

8. The electrophotographic photosensitive member and the electrostatic recording dielectric member as the image bearing member, may be a rotation belt type, on which a toner image is formed through charging, latent image formation and development. The toner image is displayed, and the belt is repeatedly used. The image forming apparatus includes such an image display device.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member;

charging means for charging said image bearing member, said charging means including magnetic field generating means and magnetic particles contactable to said image bearing member at a charging position;

developing means for developing with toner an electrostatic image formed on said image bearing member using said charging means, said developing means including carrier particles; and transferring means for transferring a toner image from said image bearing member onto a recording material, wherein said developing means is capable of collecting residual toner from said image bearing member, and wherein a magnetic confining force acting on said magnetic particles is larger than a magnetic confining force acting on said carrier particles under a magnetic field formed by said magnetic field generating means at the charging position.

2. An apparatus according to claim 1, wherein the saturation magnetization per one magnetic particle is larger than the saturation magnetization per one carrier particle under the magnetic field.

3. An apparatus according to claim 1, wherein the magnetic particle have a density which is larger than the density of the carrier particles.

4. An apparatus according to claim 1, wherein the magnetic particle have an average particle size which is larger than the average particle size of the carrier particles.

5. An apparatus according to claim 1, wherein said charging means is supplied with a DC voltage not having an AC component.

6. An apparatus according to claim 1, wherein said charging means is supplied with an AC biased DC voltage.

7. An apparatus according to any one of claims 1–6, wherein said image bearing member has a surface layer having a volume resistivity of $10^9$–$10^{14}$ Ω.cm.

8. An apparatus according to claim 7, wherein said image bearing member has an electrophotographic photosensitive layer inside said surface layer.

9. A process cartridge detachably mountable relative to an image forming apparatus, said process cartridge comprising:

an image bearing member;

charging means for charging said image bearing member, said charging means including magnetic field generating means and magnetic particles contactable to said image bearing member at a charging position; and developing means for developing with toner an electrostatic image formed on said image bearing member using said charging means, said developing means including carrier particles, wherein said developing means is capable of collecting residual toner from said image bearing member, and wherein a magnetic confining force acting on said magnetic particles is larger than a magnetic confining force acting on said carrier particles under a magnetic field formed by said magnetic field generating means at the charging position.

10. An apparatus according to claim 9, wherein the saturation magnetization per one magnetic particle is larger than the saturation magnetization per one carrier particle under the magnetic field.

11. An apparatus according to claim 9, wherein the magnetic particle have a density which is larger than the density of the carrier particles.

12. An apparatus according to claim 9, wherein the magnetic particle have an average particle size which is larger than the average particle size of the carrier particles.

13. An apparatus according to claim 9, wherein said charging means is supplied with a DC voltage not having an AC component.

14. An apparatus according to claim 9, wherein said charging means is supplied with an AC biased DC voltage.

15. An apparatus according to any one of claims 9–14, wherein said image bearing member has a surface layer having a volume resistivity of $10^9$–$10^{14}$ Ω.cm.

16. An apparatus according to claim 15, wherein said image bearing member has an electrophotographic photosensitive layer inside said surface layer.

* * * * *